US008774697B2

(12) United States Patent
Dobbertin et al.

(10) Patent No.: US 8,774,697 B2
(45) Date of Patent: Jul. 8, 2014

(54) ELECTROPHOTOGRAPHIC PRINTER AND TRANSITIONAL CLEANING SYSTEM

(75) Inventors: Michael Thomas Dobbertin, Honeoye, NY (US); Francisco Luiz Ziegelmuller, Penfield, NY (US); James Douglas Shifley, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 331 days.

(21) Appl. No.: 13/238,417

(22) Filed: Sep. 21, 2011

(65) Prior Publication Data

US 2013/0028643 A1 Jan. 31, 2013

Related U.S. Application Data

(60) Provisional application No. 61/512,949, filed on Jul. 29, 2011.

(51) Int. Cl.
*G03G 21/00* (2006.01)

(52) U.S. Cl.
USPC ..... 399/351

(58) Field of Classification Search
USPC ..... 399/350, 351
See application file for complete search history.

(56) References Cited

U.S. PATENT DOCUMENTS 3,572,923 A 3/1971 Fisher et al.
3,580,673 A 5/1971 Yang
3,655,373 A 4/1972 Fisher et al.
3,722,018 A 3/1973 Fisher
3,780,391 A 12/1973 Leenhouts
3,918,808 A 11/1975 Narita
3,947,108 A 3/1976 Thettu et al.
4,026,648 A 5/1977 Takahashi
4,089,683 A 5/1978 Knieser
4,116,555 A 9/1978 Young et al.
4,185,399 A 1/1980 Gladish
4,279,501 A 7/1981 Kojima et al.
4,373,800 A 2/1983 Kamiyama et al.
4,440,488 A * 4/1984 Maekawa et al. ..... 399/351
4,494,863 A 1/1985 Laing
4,561,766 A 12/1985 Fox
4,639,124 A 1/1987 Nye, Jr. et al.
4,819,026 A 4/1989 Lange et al.
4,989,047 A 1/1991 Jugle et al.
4,989,679 A 2/1991 Amaudric du Chaffaut
4,999,679 A 3/1991 Corbin et al.
5,031,000 A 7/1991 Pozniakas et al.
5,126,798 A 6/1992 LeRoy et al.
5,168,309 A * 12/1992 Adachi et al.

(Continued)

*Primary Examiner* — Sandra Brase
(74) *Attorney, Agent, or Firm* — Roland R. Schindler; David A. Wovais

(57) ABSTRACT

Printers and cleaning systems are provided. A cleaning system has an actuator that moves the electrostatic imaging member in a second direction opposite the first direction and a frame positions a mounting within a first range of mounting distances from the electrostatic imaging member with the mounting holding a cleaning blade at a holding angle that causes a free length of the cleaning blade to extend along a first direction to position a cleaning end of the cleaning blade to engage the electrostatic imaging member for movement therewith. The electrostatic imaging member urges the cleaning end in the second direction to deflect the cleaning blade to extend along the second direction to position the cleaning end to wipe the electrostatic imaging member and the free length, the holding angle and the working angle cause the cleaning edge to wipe at a working angle between about 85 and 89 degrees.

18 Claims, 14 Drawing Sheets

(56) References Cited

U.S. PATENT DOCUMENTS

| | | | |
|---|---|---|---|
| 5,296,894 | A | 3/1994 | Green et al. |
| 5,349,428 | A | 9/1994 | Derrick |
| 6,697,599 | B2 | 2/2004 | Scherdel |
| 6,901,227 | B2 | 5/2005 | Ziegelmuller et al. |
| 7,031,634 | B2 | 4/2006 | Ziegelmuller et al. |
| 7,587,163 | B2 | 9/2009 | Parks et al. |
| 7,796,913 | B2 | 9/2010 | Berg et al. |
| 7,929,878 | B1 * | 4/2011 | Thayer et al. ..... 399/71 |

* cited by examiner

ELECTROPHOTOGRAPHIC PRINTER AND TRANSITIONAL CLEANING SYSTEM

CROSS REFERENCE TO RELATED APPLICATIONS

This application claims the benefit of U.S. Provisional Patent Application No. 61/512,949, filed Jul. 29, 2011, which is incorporated herein by reference in its entirety.

This application relates to commonly assigned, copending U.S. application Ser. No. 13/037,632, filed Mar. 1, 2011, and U.S. application Ser. No. 13/193,671, filed Jul. 29, 2011, each of which is hereby incorporated by reference.

FIELD OF THE INVENTION

This invention pertains to the field of electrophotographic printing.

BACKGROUND OF THE INVENTION

In a typical electrophotographic printer, a latent image charge pattern is formed on an electrostatic imaging member in accordance with an image to be printed and the electrostatic image is developed with charged toner particles. The charged toner particles adhere to the latent image charge pattern on the electrostatic imaging member to form a toner image. The toner image is then transferred from the electrostatic imaging member to a transfer subsystem and from the transfer subsystem to a receiver. The toner and receiver are then fused to form a print.

In certain circumstances, less than all of the toner forming the toner image transfers from the electrostatic imaging member to the transfer system. This leaves residual toner on the electrostatic imaging member that can create unwanted artifacts in subsequent toner images formed on the electrostatic imaging member. Additionally, other material such as fuser oil, coatings and fragments of toner particles, agglomerates, carrier, paper fibers, paper coatings, dirt, dust and other charged materials in the environment surrounding the printer can be attracted to and can accumulate on the electrostatic imaging member to form a layer. This layer can be difficult to remove and can also cause unwanted artifacts in subsequent toner images formed on the electrostatic imaging member. Accordingly, electrostatic imaging members are typically cleaned between or within image printing cycles to remove any such residual toner and other material (referred to herein collectively as "residual material").

Various techniques have been developed to clean electrostatic imaging members. In some devices, magnetic or electrically biased members are used to attract residual material from an electrostatic imaging member (see for example U.S. Pat. No. 4,639,124 issued to Nye, Jr. et al. on Jan. 27, 1987.) In other devices, cleaning is performed using a fabric or other type of contact brush (see for example U.S. Pat. No. 4,999,679 issued to Corbin et al. on Mar. 12, 1991). Such brushing techniques, while generally effective at removing residual toner have proven less effective at removing the other types of residual material.

Accordingly, other types of cleaning systems have been developed to try to remove such residual material. One type of cleaning system is a scraping system in which a blade is held with a working face that extends toward an electrostatic imaging member in a direction that opposes the direction of movement of the electrostatic imaging member. In such systems, residual material is scraped from the electrostatic imaging member as the electrostatic imaging member is moved past the blade.

One example of a scraping system is U.S. Pat. No. 3,947,108 issued to Thettu et al. on Mar. 30, 1976. In the '108 patent, a blade is shown that oscillates back and forth across a drum during cleaning. The blade has a leading edge in contact with a surface of the drum. The blade is positioned so that the blade extends toward the drum in a direction opposite to a direction of drum rotation to shear material from the face of the drum. However, in the '108 patent, the blade is used to remove residual toner particles so as make a secondary brush cleaner more efficient at removing a film of other material from the drum.

In U.S. Pat. No. 4,989,047 issued to Jugle et al. on Jan. 29, 1991, a thin scraper member is provided as a secondary cleaner to remove agglomerations of toner and debris from an electrostatic imaging member after a cleaning brush has had an opportunity to clean the electrostatic imaging member. FIG. 1, which is adapted from FIG. 2B of the '047 patent, shows one embodiment of a thin scraper 300 that extends from a holder 302 toward an electrostatic imaging member 304 in a direction 306 that is the opposite of a direction of movement 308 of the electrostatic imaging member 304.

As is also shown in FIG. 1 scraper 300 extends from holder 302 at a first angle 310 and contacts electrostatic imaging member 304 at a shallow working angle 312. This approach advantageously allows scraper 300 to provide a substantial amount of cleaning force FC against any residual materials on electrostatic imaging member 304 while applying only a limited amount of normal force FN against electrostatic imaging member 304. A very low scraping angle is used, for example between just over 0 and up to 9 degrees and a load is applied to help keep the scraping blade against the surface being cleaned.

However, scraping systems are subject to a failure mode known as blade tuck or "tuck under". FIG. 2 shows an example of this condition in the context of the scraper shown in FIG. 1. As is shown in FIG. 2, a blade tuck occurs when a leading edge 314 of a scraper 300 folds under scraper 300. Blade "tuck" can happen because, for example, the frictional force between leading edge 314 and electrostatic imaging member 304 reaches a high enough level to cause leading edge 314 to move with electrostatic imaging member 304.

A tucked under scraper 300 creates a normal force FN against the electrostatic imaging member 304 that can be substantially greater than the normal force FN of scraper 300 in a normal state and provides substantially reduced cleaning force FC. This can create wear marks and scratches on the electrostatic imaging member 304, reduce the useful life of scraper 300 and the electrostatic imaging member 304 as well as interrupting work flow and wasting consumables.

In embodiments described in the '047 patent the blades are mounted in a movable mountings that allow the scraping blades to be moved in the vertical direction and a low load is placed on the blades so that a maximum shearing force can be applied by the blade. This is done to avoid the problems associated with normal cleaning engagement of blades with a charge retentive surface. According to the '047 patent, because of the low load of the blade, the minimal amount of toner that normally passes through any cleaning system serves as a lubricant for the blade without the need for further added lubricant.

U.S. Pat. No. 5,031,000, issued to Pozniakas et al. which is a continuation in part from the application leading to the '047 patent, provides claims that are directed to a blade supported in a floating support assembly. The blade floats under a low weight during break in of a new blade to prevent tuck under and damage to the blade. The weight applied to the blade is optimized for the break in period and the support assembly has a stop to prevent blade creep during normal operations.

U.S. Pat. No. 5,349,428, issued to Derrick on Sep. 20, 1994, also notes that the leading edges of scraping blades are subject to a failure mode known as blade "tuck". The '428 patent proposed to solve this problem using a variable position drum.

Because scrapers oppose the direction of motion of the electrostatic imaging member another problem that can arise with the use of a scraper is the so called "chatter" problem. Chatter occurs because the coefficient of static friction between the scraper and the electrostatic imaging member is greater than the coefficient of dynamic friction between the scraper and the electrostatic imaging member. Accordingly, when movement of the electrostatic imaging member is slow the coefficient of static friction can cause the scraper to deflect in the direction of motion of the electrostatic imaging member until sufficient elastic energy is stored in the scraper to allow the scraper to overcome the static friction causing rapid movement of the cleaning edge of the scraper. This rapid movement reduces cleaning efficiency and creates bands of uncleaned or partially cleaned areas on the electrostatic imaging member.

Alternatively it has been known to clean an electrostatic imaging member using a wiper. FIG. 3 illustrates one example of a wiper type cleaning system 318. In this example, wiper 320 is held by a holder 322. Holder 322 extends toward electrostatic imaging member 304 in a direction 324 of movement of electrostatic imaging member 304. Because such wipers extend toward the electrostatic imaging member 304 in the direction of movement of the electrostatic imaging member, wiper type cleaning systems are not subject to the blade "tuck" failure mode that occurs with scrapers. Wiper cleaning systems 318 however have working angles 326 that are higher than the working angles used in scraper systems. For this reason wiper cleaning systems 318 typically apply a greater amount of normal force FN against the electrostatic imaging member 304 being cleaned to achieve a desired cleaning force FC than do scraper systems. This can increase the amount of friction acting on an electrostatic imaging member 304 and can impact the useful life of the electrostatic imaging member 304 and wiper 320. Such results can become particularly pronounced where a high cleaning force FC is required.

The working angle 326 of the wiper 320 is established as a function of holding angle 328 at which wiper 320 is held and the free length L of wiper 320 when unbent (shown in phantom in FIG. 3), and a variety of factors including the separation distance 325 between holder 322 and electrostatic imaging member 304. Ultimately, the holding angle 328 determines the highest possible working angle 328 for a wiper, with other factors controlling the extent to which the working angle 326 will deviate from holding angle 328.

It will be appreciated that in a wiping system such as wiping system 318 there can be variations in these factors and that wiping system 318 will be defined in a manner that provides a minimum cleaning force FC at all possible working angles 326 within the range of variability in these factors. This typically requires that wiping system 318 provides this minimum cleaning force FC over a wide range of working angles 326. When wiping system 318 is operated at low working angles 326 in the range, the amount of normal force FN that must be applied to the electrostatic imaging member 312 to achieve the minimum desired cleaning force FC increases significantly.

What is needed therefore is a cleaning solution that removes residual materials from an electrostatic imaging member and that also does so with limited normal force, reduced chatter and reduced risk of blade "tuck" incidents.

SUMMARY OF THE INVENTION

Printers and cleaning systems are provided. A cleaning system has an actuator that moves the electrostatic imaging member in a second direction opposite the first direction and a frame positions a mounting within a first range of mounting distances from the electrostatic imaging member with the mounting holding a cleaning blade at a holding angle that causes a free length of the cleaning blade to extend along a first direction to position a cleaning end of the cleaning blade to engage the electrostatic imaging member for movement therewith. The electrostatic imaging member urges the cleaning end in the second direction to deflect the cleaning blade to extend along the second direction to position the cleaning end to wipe the electrostatic imaging member and the free length, the holding angle and the working angle cause the cleaning edge to wipe at a working angle between about 85 and 89 degrees.

DETAILED DESCRIPTION OF THE DRAWINGS

FIGS. 8A and 8B, 9, and 10 show a transitional cleaning system in greater detail.

Figure 11:
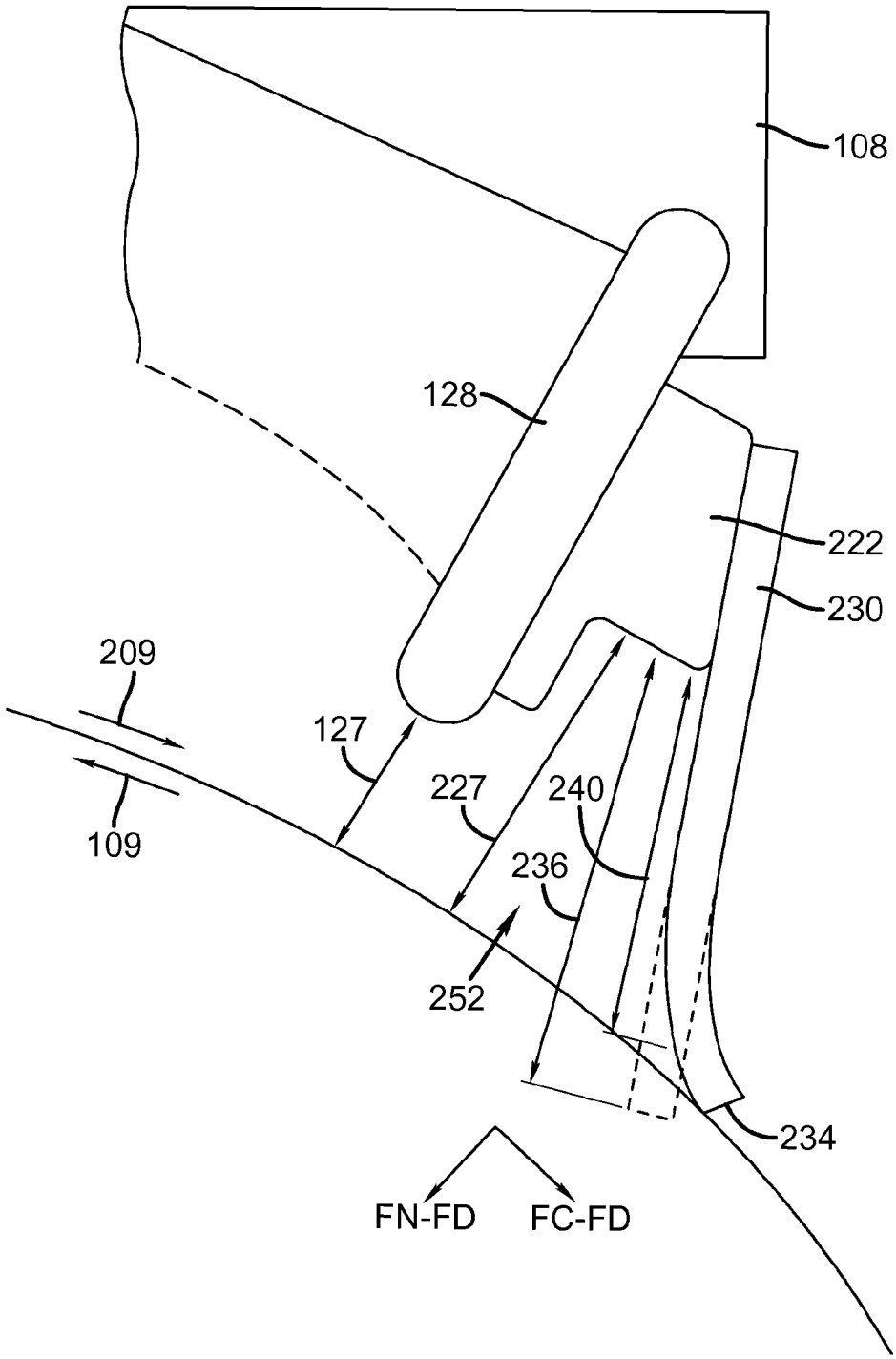

FIG. 11 shows the transitional cleaning system with the cleaning blade in an engagement position.

Figure 12:
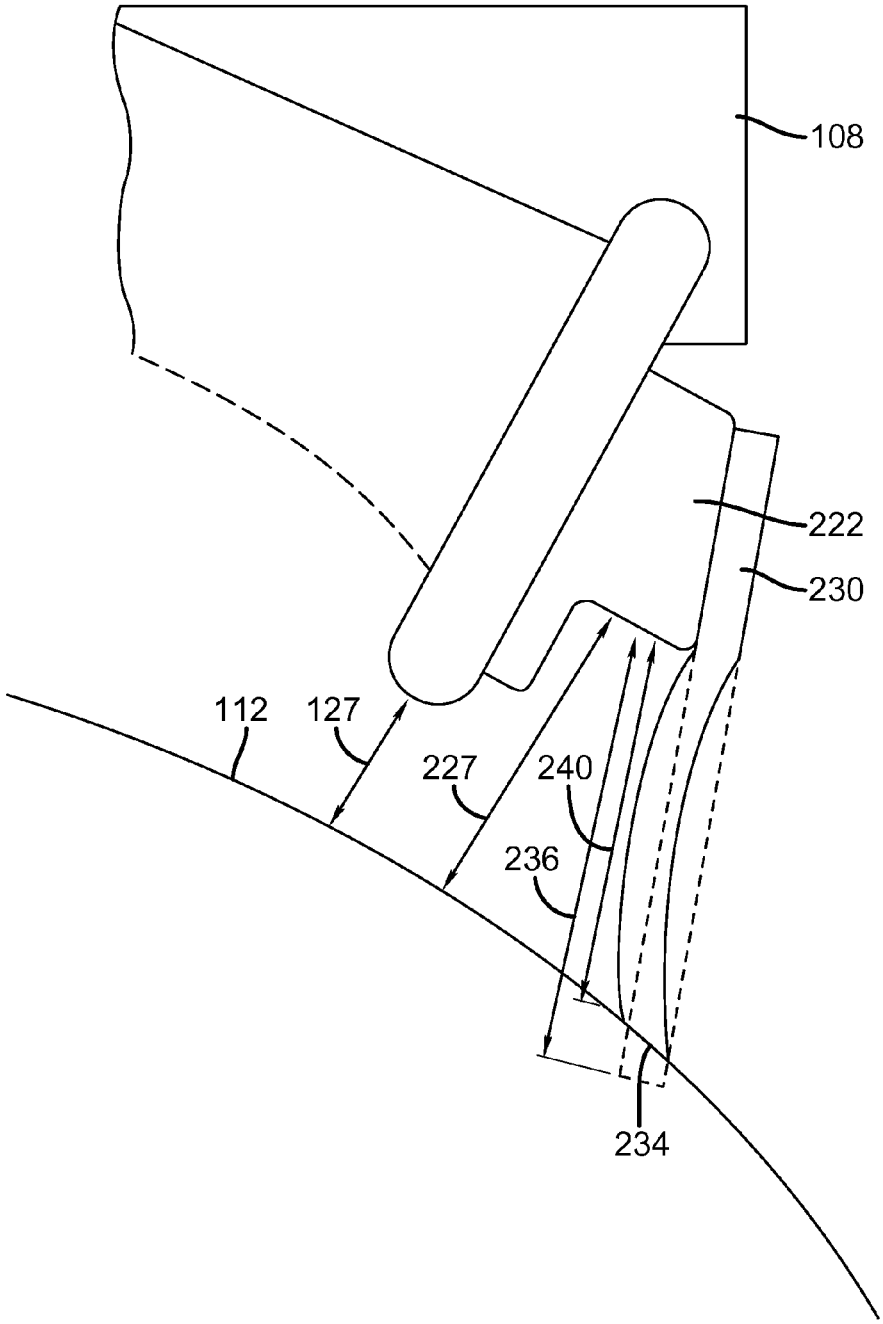

FIG. 12 shows the transitional cleaning system during transition of the cleaning blade from an engagement position to a wiping position.

Figure 13:
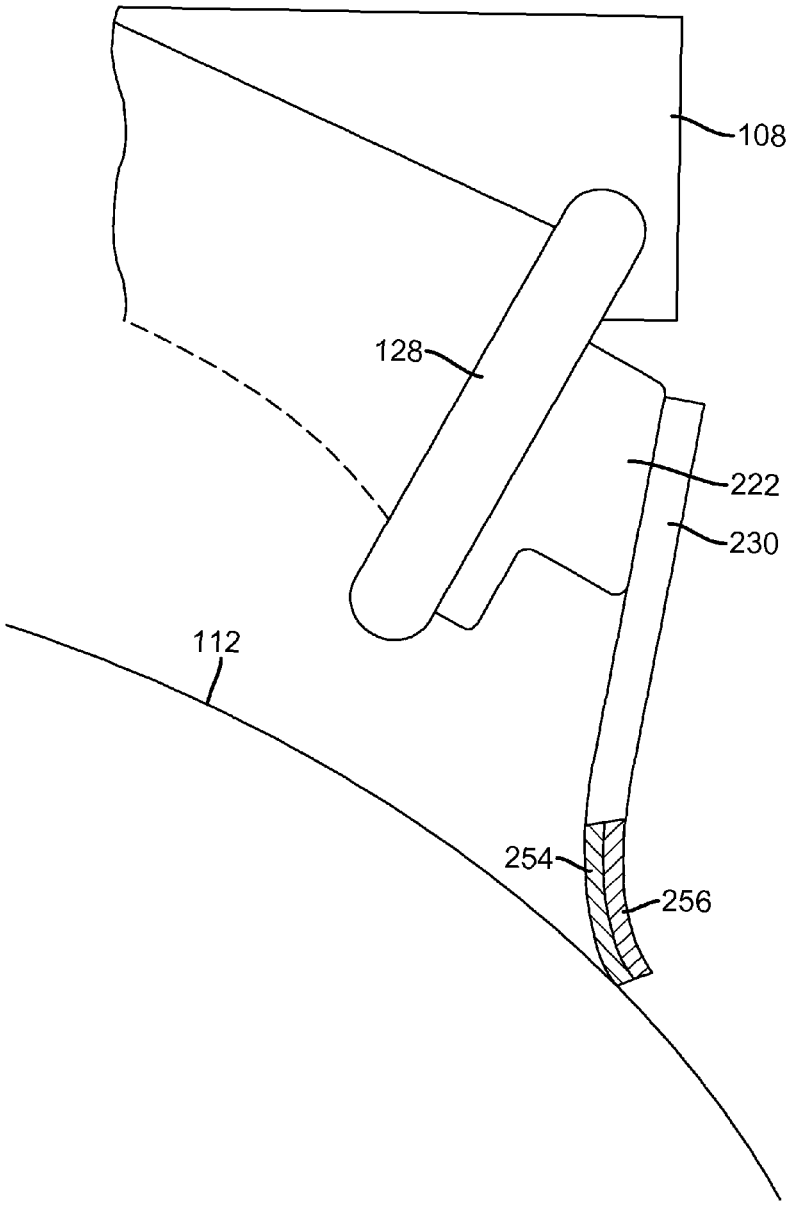

FIG. 13 shows an embodiment of a cleaning blade with a cleaning end having a first side and a second side that are different.

DETAILED DESCRIPTION OF THE INVENTION

Figure 1:
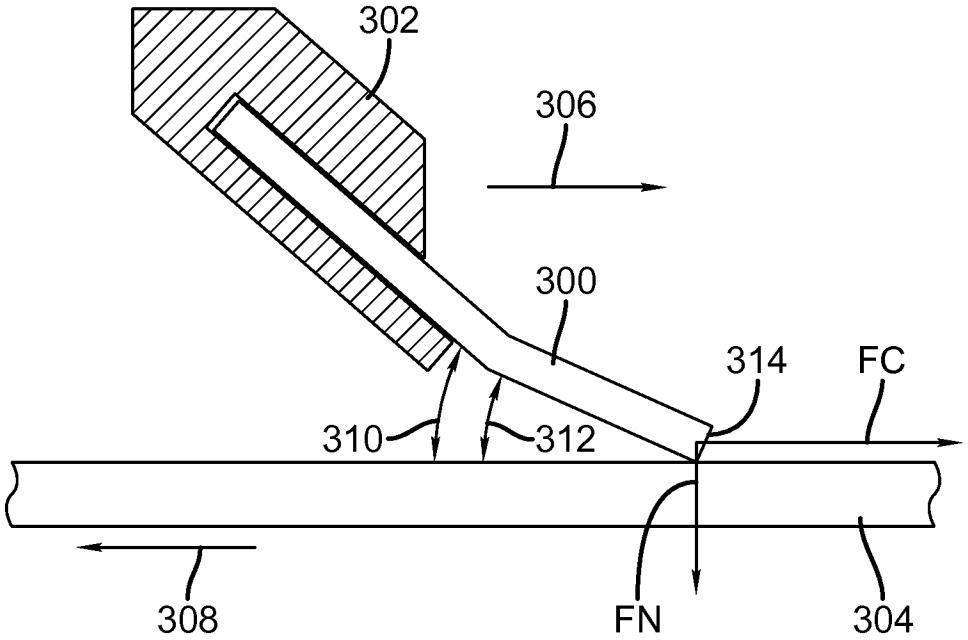
FIG. 1 (PRIOR ART)
FIG. 1 shows one example of a prior art scraper system.
Figure 2:
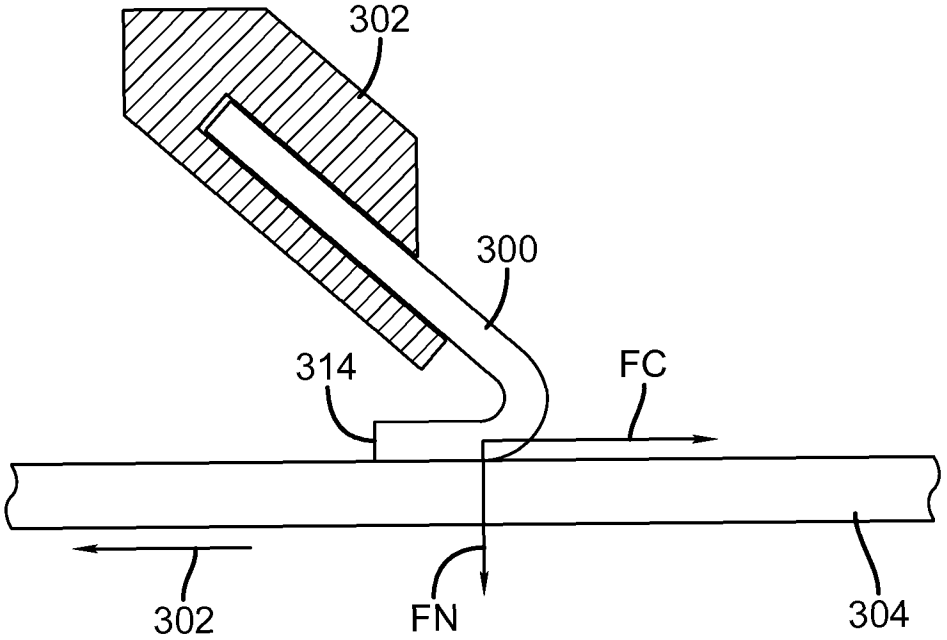
FIG. 2 (PRIOR ART)
FIG. 2 shows the example of FIG. 1 during a tuck under incident.
Figure 3:
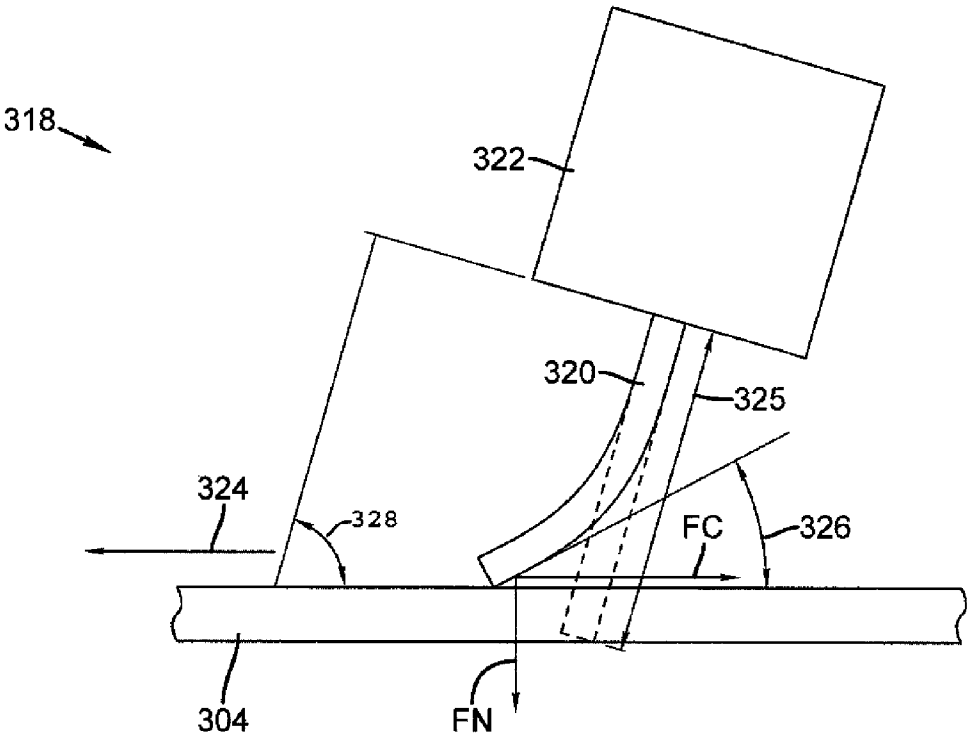
FIG. 3 (PRIOR ART)
FIG. 3 shows one example of a prior art wiper system.
Figure 4:
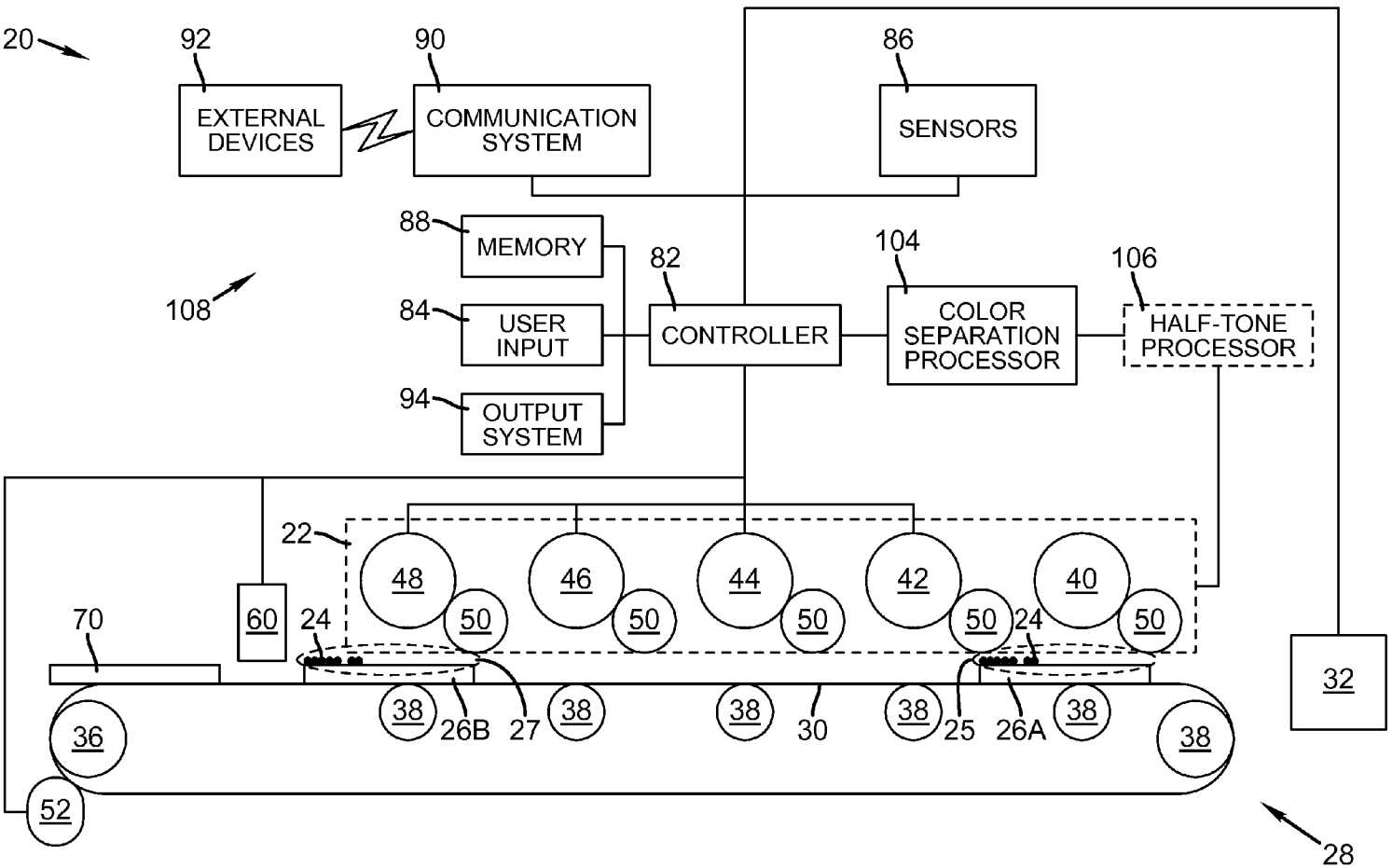
FIG. 4 shows a system level illustration of one embodiment of an electrophotographic printer.

FIG. 4 is a system level illustration of a printer 20. In the embodiment of FIG. 4, printer 20 has a print engine 22 of an electrophotographic type that deposits toner 24 to form a toner image 25 in the form of a patterned arrangement of toner stacks. Toner image 25 can include any patternwise application of toner 24 and can be mapped according to data representing text, graphics, photo, and other types of visual content, as well as patterns that are determined based upon desirable structural or functional arrangements of the toner 24.

Toner 24 is a material or mixture that contains toner particles and that can form an image, pattern, or indicia when electrostatically deposited on an imaging member including a photoreceptor, photoconductor, electrostatically-charged, or magnetic surface. As used herein, "toner particles" are the particles that are electrostatically transferred by print engine 22 to form a pattern of material on a receiver 26 to convert an electrostatic latent image into a visible image or other pattern of toner 24 on receiver. Toner particles can also include clear particles that have the appearance of being transparent or that while being generally transparent impart a coloration or opacity. Such clear toner particles can provide for example a protective layer on an image or can be used to create other effects and properties on the image. The toner particles are fused or fixed to bind toner 24 to a receiver 26.

Toner particles can have a range of diameters, e.g. less than 4 μm, on the order of 5-15 μm, up to approximately 30 μm, or larger. When referring to particles of toner 24, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. Toner 24 is also referred to in the art as marking particles or dry ink. In certain embodiments, toner 24 can also comprise particles that are entrained in a liquid carrier.

Typically, receiver 26 takes the form of paper, film, fabric, metallicized or metallic sheets or webs. However, receiver 26 can take any number of forms and can comprise, in general, any article or structure that can be moved relative to print engine 22 and processed as described herein.

Print engine 22 has one or more printing modules, shown in FIG. 4 as printing modules 40, 42, 44, 46, and 48 that are each used to deliver a single an application of toner 24 to form a toner image 25 on receiver 26A. For example, the toner image 25 shown formed on receiver 26A in FIG. 4 can provide a monochrome image or layer of a structure or other functional material or shape.

Print engine 22 and a receiver transport system 28 cooperate to deliver one or more toner image 25 in registration to form a composite toner image 27 such as the one shown formed in FIG. 4. as being formed on receiver 26B. Composite toner image 27 can be used for any of a plurality of purposes, the most common of which is to provide a printed image with more than one color. For example, in a four color image, four toner images are formed each toner image having one of the four subtractive primary colors, cyan, magenta, yellow, and black. These four color toners can be combined to form a representative spectrum of colors. Similarly, in a five color image various combinations of any of five differently colored toners can be combined to form a color print on receiver 26. That is, any of the five colors of toner 24 can be combined with toner 24 of one or more of the other colors at a particular location on receiver 26 to form a color after a fusing or fixing process that is different than the colors of the toners 24 applied at that location.

In FIG. 4, print engine 22 is illustrated as having an optional arrangement of five printing modules 40, 42, 44, 46, and 48, also known as electrophotographic imaging subsystems arranged along a length of receiver transport system 28. Each printing module delivers a single toner image 25 to a respective transfer subsystem 50 in accordance with a desired pattern. The respective transfer subsystem 50 transfers the toner image 25 onto a receiver 26 as receiver 26 is moved by receiver transport system 28. Receiver transport system 28 comprises a movable surface 30 that positions receiver 26 relative to printing modules 40, 42, 44, 46, and 48. In this embodiment, movable surface 30 is illustrated in the form of an endless belt that is moved by motor 36, that is supported by rollers 38, and that is cleaned by a cleaning mechanism 52. However, in other embodiments receiver transport system 28 can take other forms and can be provided in segments that operate in different ways or that use different structures. In operation, printer controller 82 causes one or more of individual printing modules 40, 42, 44, 46 and 48 to generate a toner image 25 of a single color of toner for transfer by respective transfer subsystems 50 to receiver 26 in registration to form a composite toner image 27. In an alternate embodiment, not shown, printing modules 40, 42, 44, 46 and 48 can each deliver a single application of toner 24 to a composite transfer subsystem 50 to form a combination toner image thereon which can be transferred to a receiver.

Printer 20 is operated by a printer controller 82 that controls the operation of print engine 22 including but not limited to each of the respective printing modules 40, 42, 44, 46, and 48, receiver transport system 28, receiver supply 32, and transfer subsystem 50, to cooperate to form toner images 25 in registration on a receiver 26 or an intermediate in order to yield a composite toner image 27 on receiver 26 and to cause fuser 60 to fuse composite toner image 27 on receiver 26 to form a print 70 as described herein or otherwise known in the art.

Printer controller 82 operates printer 20 based upon input signals from a user input system 84, sensors 86, a memory 88 and a communication system 90. User input system 84 can comprise any form of transducer or other device capable of receiving an input from a user and converting this input into a form that can be used by printer controller 82. Sensors 86 can include contact, proximity, electromagnetic, magnetic, or optical sensors and other sensors known in the art that can be used to detect conditions in printer 20 or in the environment-surrounding printer 20 and to convert this information into a form that can be used by printer controller 82 in governing printing, fusing, finishing or other functions.

Memory 88 can comprise any form of conventionally known memory devices including but not limited to optical, magnetic or other movable media as well as semiconductor or other forms of electronic memory. Memory 88 can contain for example and without limitation image data, print order data, printing instructions, suitable tables and control software that can be used by printer controller 82.

Communication system 90 can comprise any form of circuit, system or transducer that can be used to send signals to or receive signals from memory 88 or external devices 92 that are separate from or separable from direct connection with printer controller 82. External devices 92 can comprise any type of electronic system that can generate signals bearing data that may be useful to printer controller 82 in operating printer 20.

Printer 20 further comprises an output system 94, such as a display, audio signal source or tactile signal generator or any other device that can be used to provide human perceptible signals by printer controller 82 to feedback, informational or other purposes.

Printer 20 prints images based upon print order information. Print order information can include image data for printing and printing instructions and can be generated locally at a printer 20 or can be received by printer 20 from any of variety of sources including memory system 88 or communication system 90. In the embodiment of printer 20 that is illustrated in FIG. 4 printer controller 82 has a color separation image processor 104 to convert the image data into color separation images that can be used by printing modules 40-48 of print engine 22 to generate toner images. An optional half-tone processor 106 is also shown that can process the color separation images according to any half-tone screening requirements of print engine 22.

Figure 5:
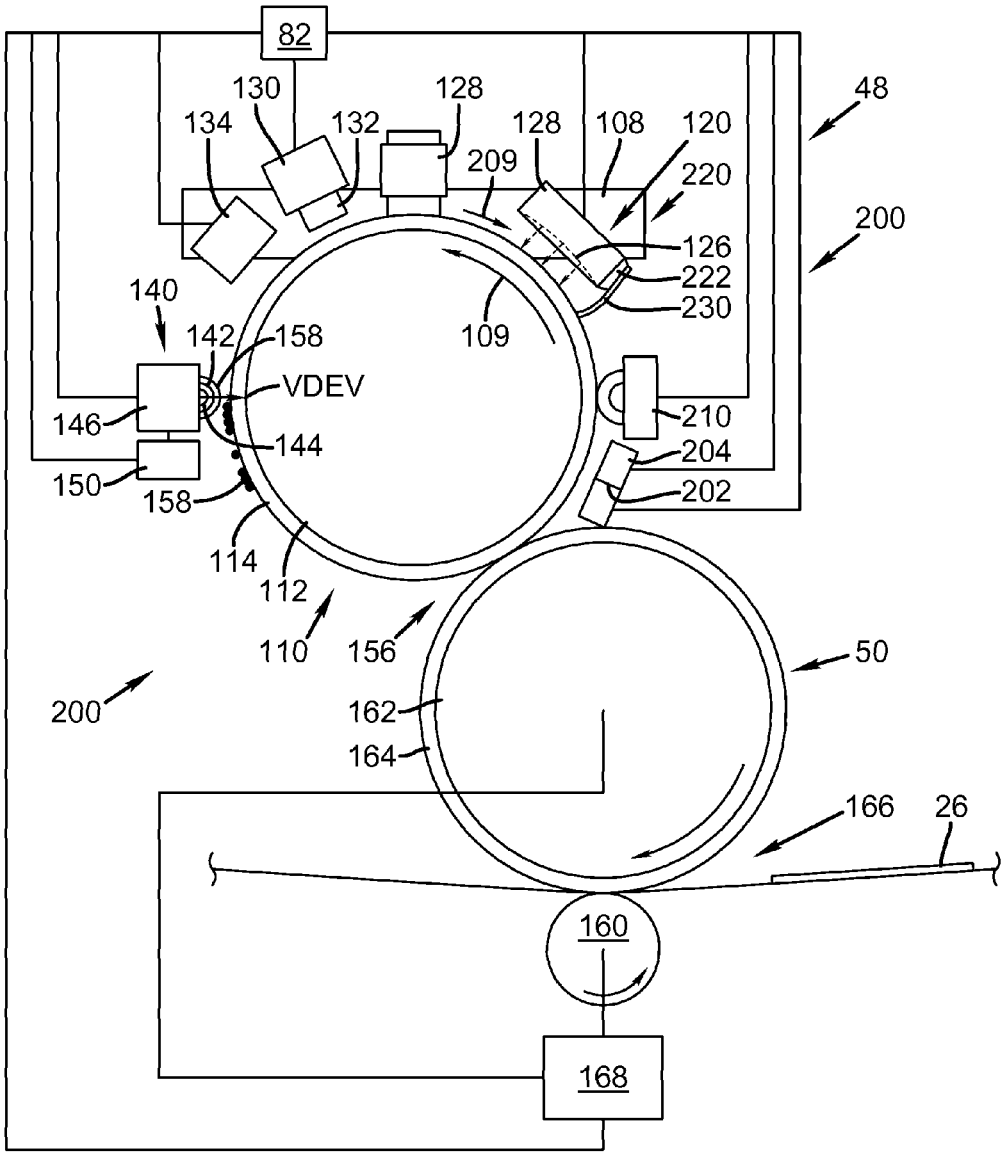
FIGS. 5, 6 and 7 illustrate a printing module during printing and cleaning operations.
Figure 6:
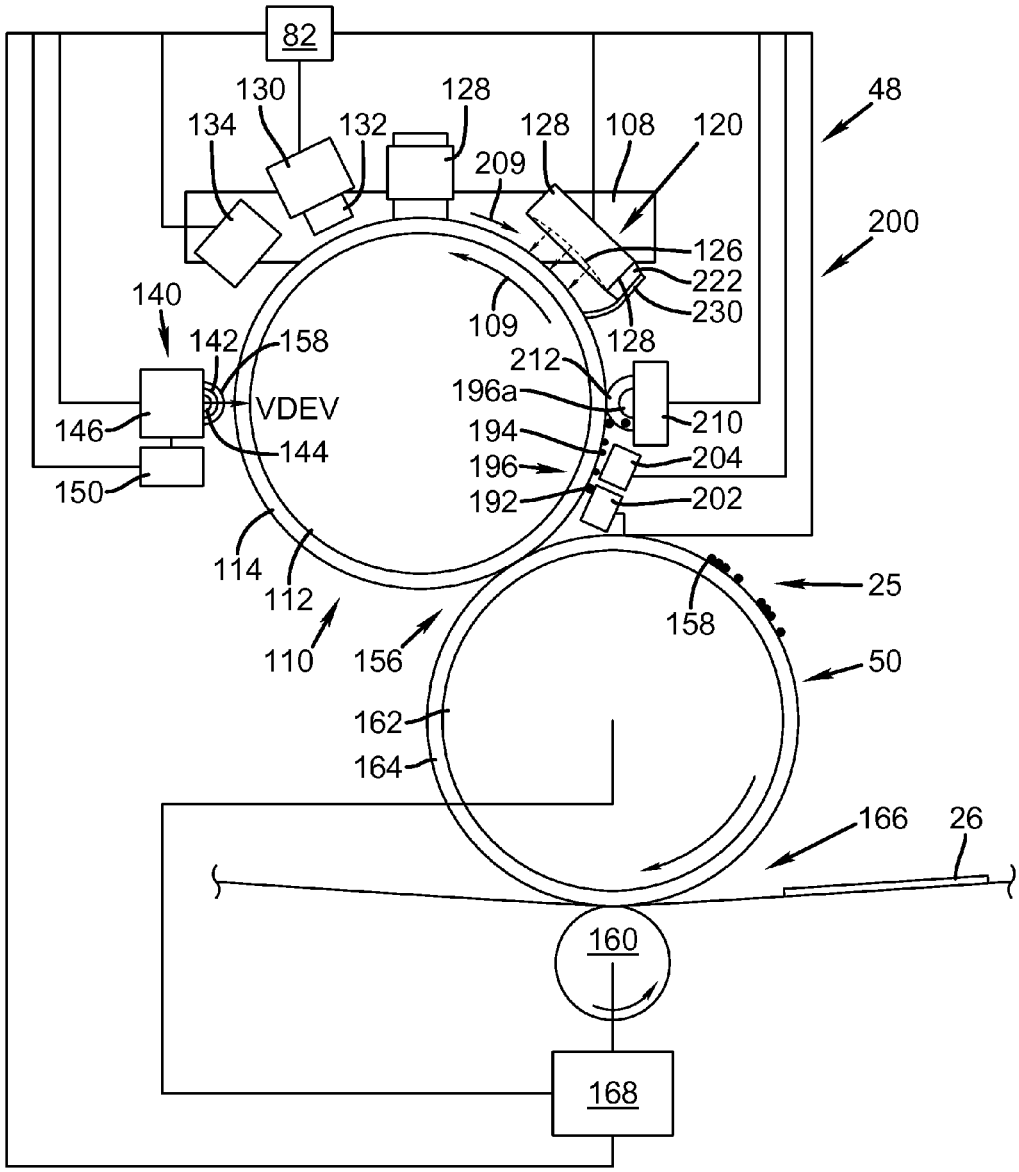
Figure 7:
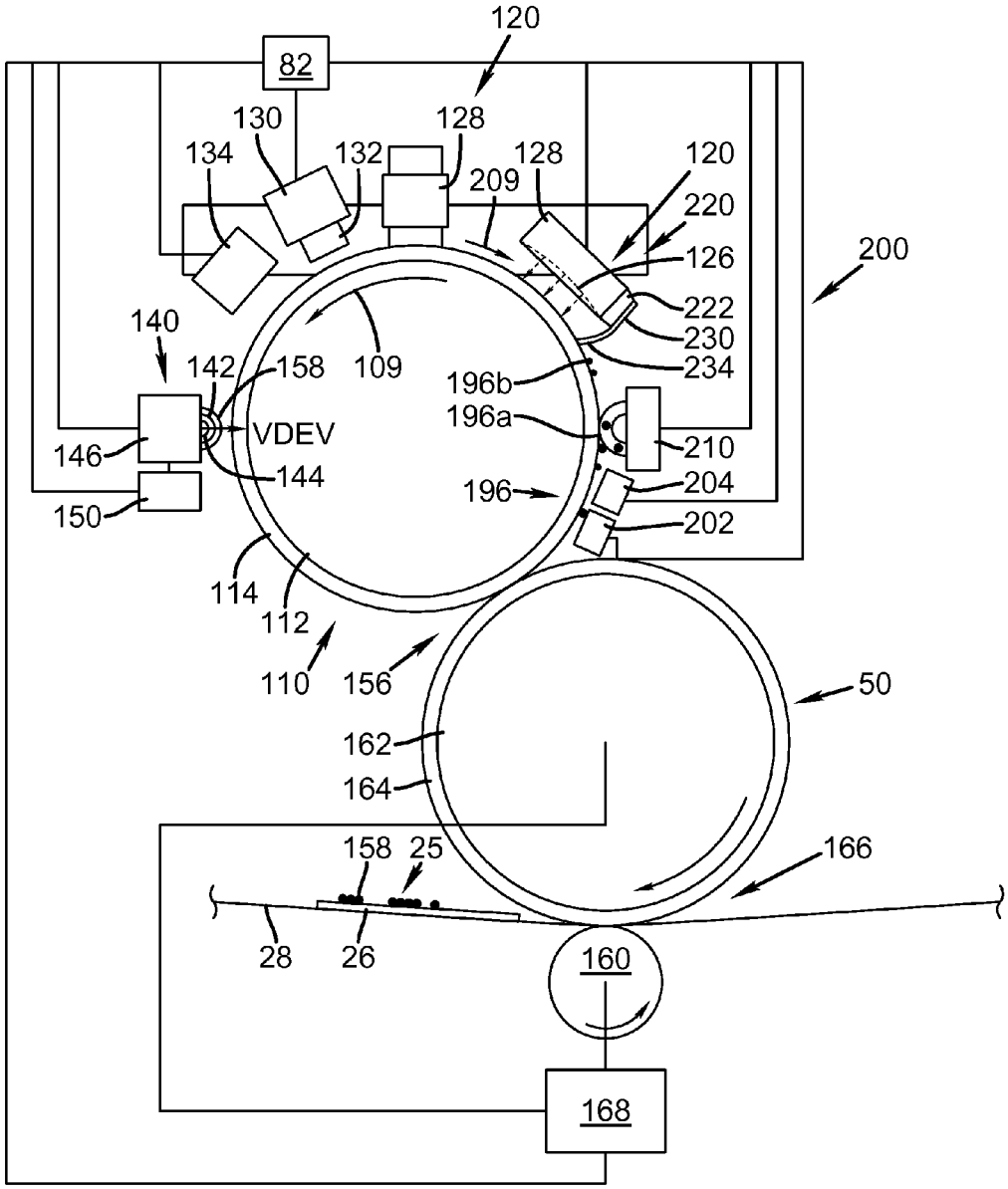

FIGS. 5, 6 and 7 show more details of an example of a printing module 48 representative of printing modules 40, 42, 44, and 46 of FIG. 4. In this embodiment, printing module 48 has a frame 108, a primary imaging system 110, and a charging subsystem 120, a writing subsystem 130, a development station 140 and a cleaning system 200 that are each ultimately responsive to printer controller 82. Each printing module can also have its own respective local controller (not shown) or hardwired control circuits (not shown) to perform local control and feedback functions for an individual module or for a subset of the printing modules. Such local controllers or local hardwired control circuits are coupled to printer controller 82.

Primary imaging system 110 includes an electrostatic imaging member 112. In the embodiment of FIGS. 5, 6, and 7 electrostatic imaging member 112 takes the form of an imaging cylinder. However, in other embodiments, electrostatic imaging member 112 can take other forms, such as a belt or plate. In FIGS. 5, 6, and 7 electrostatic imaging member 112 is rotated by a motor (not shown) in an direction of movement 109 such that electrostatic imaging member 112 rotates from charging subsystem 120, to writing subsystem 130 to development station 140 and into a transfer nip 156 with a transfer subsystem 50 and past cleaning system 200 during a single revolution.

In the embodiment of FIGS. 5, 6 and 7, electrostatic imaging member 112 has a photoreceptor 114. Photoreceptor 114 includes a photoconductive layer formed on an electrically conductive substrate. The photoconductive layer is an insulator in the substantial absence of light so that initial differences of potential Vi can be retained on its surface. Upon exposure to light, the charge of the photoreceptor in the exposed area is dissipated in whole or in part as a function of the amount of the exposure. In various embodiments, photoreceptor 114 is part of, or disposed over, the surface of electrostatic imaging member 112. Photoreceptor layers can include a homogeneous layer of a single material such as vitreous selenium or a composite layer containing a photoconductor and another material. Photoreceptor layers can also contain multiple layers.

Charging subsystem 120 is configured as is known in the art, to apply charge to photoreceptor 114. The charge applied by charging subsystem 120 creates a generally uniform initial difference of potential Vi relative to ground. The initial difference of potential Vi has a first polarity which can, for example, be a negative polarity. Here, charging subsystem 120 has a charging subsystem housing 128 within which a charging grid 126 is located. Grid 126 is driven by a power source (not shown) to charge photoreceptor 114. Other charging systems can also be used.

To provide generally uniform initial differences of potential charging, grid 126 is positioned within a narrow range of charging distances from electrostatic imaging member 112. Grid 126 in turn is positioned by charging subsystem housing 128, thus charging subsystem housing 128 in turn is positioned within the narrow range of charging distances from electrostatic imaging member 112. In this regard, both electrostatic imaging member 112 and charging subsystem housing 128 are joined to a frame 108 in a manner that allows such precise positioning. Frame 108 can comprise any form of mechanical structure to which charging subsystem and electrostatic imaging member 112 can be joined in a controlled positional relationship at least for printing operations. Frame 108 can comprise a unitary structure or an assembly of individual structures as is known in the art. As will be discussed in greater detail below in certain embodiments, during maintenance operations, it can be useful to allow charging subsystem housing 128 to be joined to frame 108 in a manner that can be to be moved in a controllable fashion from the controlled positional relationship used for charging to a maintenance position. Frame 108 can support other components of printing module 48 including writing system 130, development station 140 and transfer subsystem 50.

As is also shown in FIGS. 5, 6 and 7, in this embodiment, an optional meter 128 is provided that measures the electrostatic charge on photoreceptor 114 after initial charging and that provides feedback to, in this example, printer controller 82, allowing printer controller 82 to send signals to adjust settings of the charging subsystem 120 to help charging subsystem 120 to operate in a manner that creates a desired initial difference of potential Vi on photoreceptor 114. In other embodiments, a local controller or analog feedback circuit or the like can be used for this purpose.

Writing subsystem 130 is provided having a writer 132 that forms patterns of differences of potential on a electrostatic imaging member 112. In this embodiment, this is done by exposing electrostatic imaging member 112 to electromagnetic or other radiation that is modulated according to color separation image data to form a latent electrostatic image (e.g., of a color separation corresponding to the color of toner deposited at printing module 48) and that causes electrostatic imaging member 112 to have a pattern of image modulated differences of potential at engine pixel location thereon. Writing subsystem 130 creates the differences of potential at engine pixel locations on electrostatic imaging member 112 in accordance with information or instructions provided by any of printer controller 82, color separation image processor 104 and half-tone processor 106 as is known in the art.

Another meter 134 is optionally provided in this embodiment and measures charge within a non-image test patch area of photoreceptor 114 after the photoreceptor 114 has been exposed to writer 132 to provide feedback related to differences of potential created using writer 132 and photoreceptor 114. Other meters and components (not shown) can be included to monitor and provide feedback regarding the operation of other systems described herein so that appropriate control can be provided.

Development station 140 has a toning shell 142 that provides a developer having a charged toner 158 near electrostatic imaging member 112. Development station 140 also has a supply system 146 for providing the charged toner 158 to toning shell 142 and supply system 146 can be of any design that maintains or that provides appropriate levels of charged toner 158 at toning shell 142 during development. Often supply system 146 charges toner 158 using a technique known as tribocharging in which toner 158 and a carrier are mixed. During this mixing process abrasive contact between toner 158 and the carrier can cause small particles of toner 158 and materials such as coatings that are applied to the toner 158 to separate from the toner. These small particles can migrate to the electrostatic imaging member 112 during development to form at least some of residual material on electrostatic imaging member 112.

Development station 140 also has a power supply 150 for providing a bias for toning shell 142. Power supply 150 can be of any design that can maintain the bias described herein. In the embodiment illustrated here, power supply 150 is shown optionally connected to printer controller 82 which can be used to control the operation of power supply 150.

The bias at toning shell 142 creates a development difference of potential VDEV relative to ground. The development difference of potential VDEV forms a net development difference of potential between toning shell 142 and individual engine pixel locations on electrostatic imaging member 112. Toner 158 develops at individual engine pixel locations as a function of net development difference of potential. Such development produces a toner image 25 on electrostatic imaging member 112 having toner quantities associated with the engine pixel locations that correspond to the engine pixel levels for the engine pixel locations.

As is shown in FIG. 6, after a toner image 25 is formed, rotation of electrostatic imaging member 112 causes toner image 25 to move through a first transfer nip 156 between electrostatic imaging member 112 and a transfer subsystem 50. In this embodiment, transfer subsystem 50 has an intermediate transfer member 162 that receives toner image 25 at first transfer nip 156. Intermediate transfer member then rotates to move toner image 25 to a second transfer nip 166. Transfer subsystem 50 including a transfer back-up member 160 opposite transfer member 162 at second transfer nip 166. In this embodiment, intermediate transfer member 162 is shown having an optional compliant transfer surface 164. A transfer power supply 168 is provided that creates a difference of potential between primary imaging member 112, and a difference of potential between intermediate transfer member 162 and transfer back-up member 160. As is also shown in FIG. 6, a substantial portion of the toner 158 used in forming toner image 25 transfers to transfer sub-system 50. However a residual amount 192 of toner 158 from toner image 25 remains on electrostatic imaging member 112. Further, other residual material 194 can be attracted to electrostatic imaging member 112 to form a layer or film thereon. Examples of such other residual material can include but is not limited to additives and coatings applied to the toner, agglomerates, carrier, paper fibers, dirt, dust and other particles that are attracted by a charged surface such as electrostatic imaging member 112. Collectively such residual material 196 advances with electrostatic imaging member 112 as it rotates away from transfer nip 156 and into cleaning system 200.

In the embodiment that is illustrated in FIGS. 5, 6, and 7, electrostatic imaging member 112 carries residual material 196 away from electrostatic imaging member 112 and past a pre-cleaning charger 202 and a charge eraser 204. Pre-cleaning charger 202 applies a charge to the surface of electrostatic imaging member 112 to facilitate removal of residual material 196 while charge eraser 204 acts to cause any residual difference of potential on electrostatic imaging member 112 to be discharged in preparation for the next writing operation.

As is also shown in FIG. 6, after electrostatic imaging member 112 passes charge eraser 204, electrostatic imaging member 112 reaches a first cleaner 210. In the embodiment that is illustrated in FIG. 6, first cleaner 210 has a brush system 212 that rotates against electrostatic imaging member 112 and that is electrically biased so as to draw a first portion 196*a* of residual material 196 from electrostatic imaging member 112. Such a brush type embodiment of first cleaner 210 is recognized as being generally effective at removing residual toner particles 192 from electrostatic imaging member 112 and may remove some of the other residual material 194. Alternatively other cleaning systems known in the art can be used for first cleaner 210.

As is illustrated in FIG. 7 after electrostatic imaging member 112 rotates past first cleaner 210, at least a second portion 196*b* of residual material 196 remains on electrostatic imaging member 112. As shown here, second portion 196*b* typically includes other residual material 194; however, in some instances second portion 196*b* can include toner 158. As is also shown in FIG. 7, further rotation of electrostatic imaging member 112 causes second portion 196*b* of residual material 196 is advanced to transitional cleaning system 220.

Figure 8A:
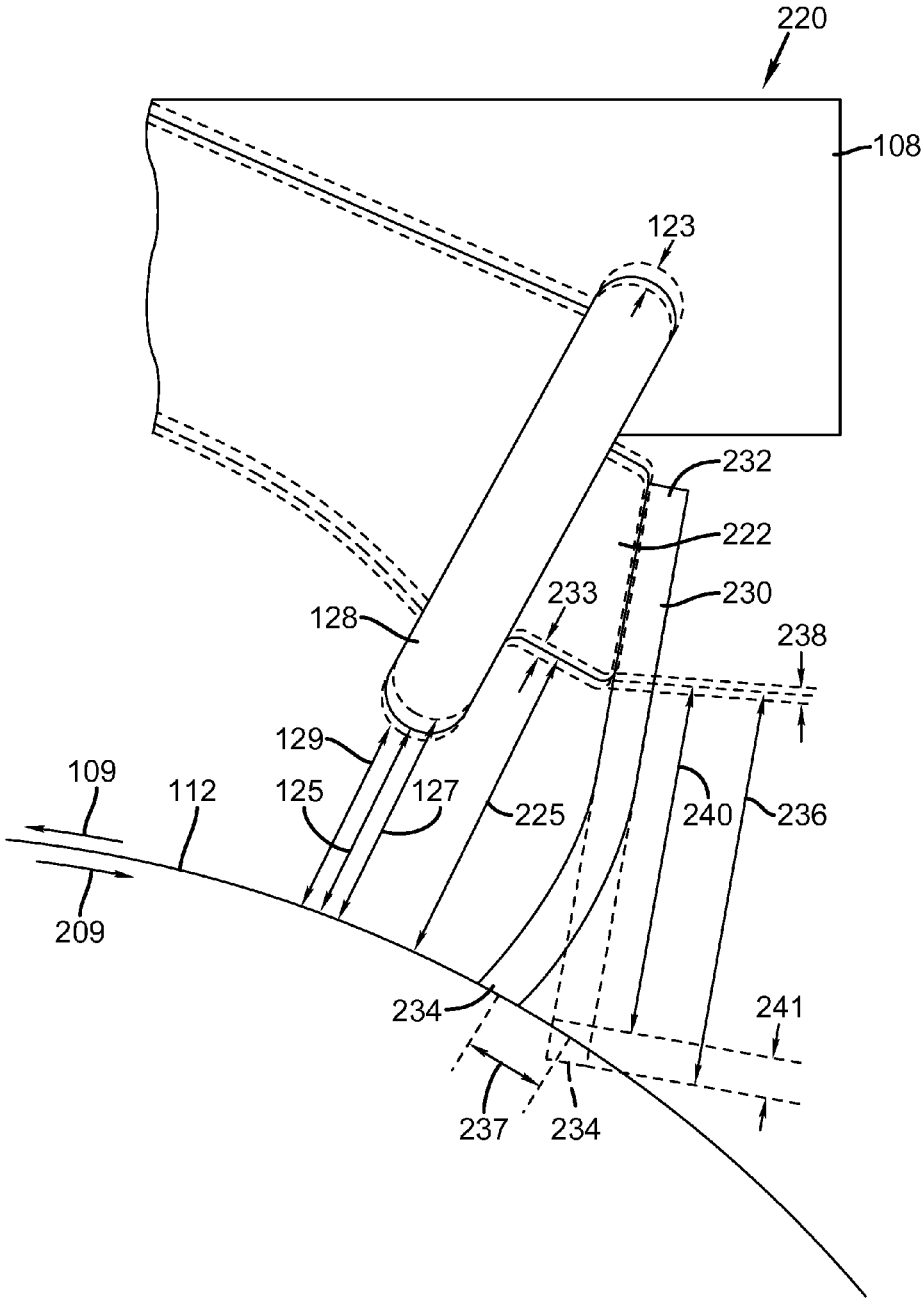
Figure 8B:
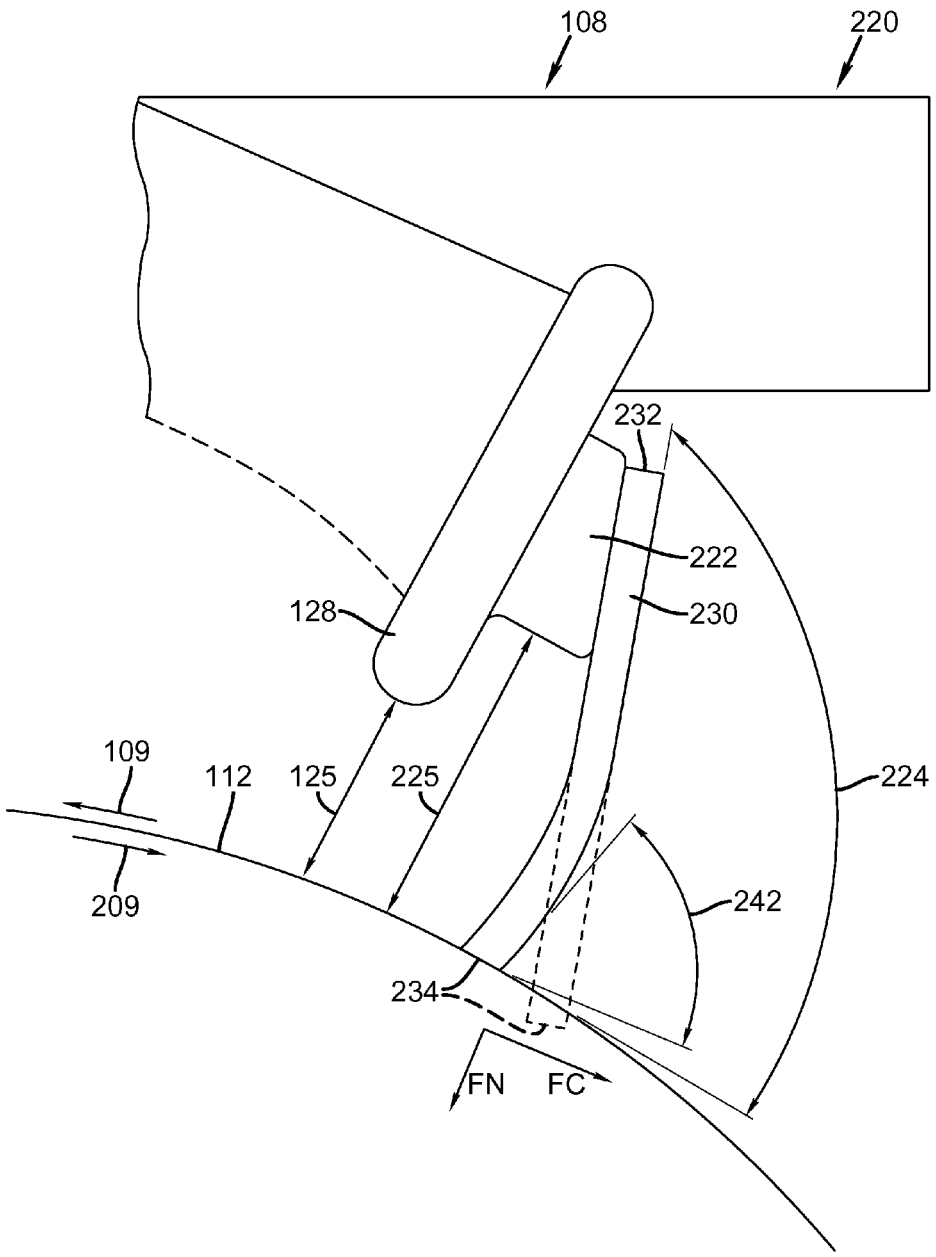

FIGS. 8A and 8B show transitional cleaning system 220 in greater detail. As is shown in FIGS. 8A and 8B in this embodiment, transitional cleaning system 220 comprises a mounting 222 joined to frame 108 to which electrostatic imaging member 112 is also mounted and a cleaning blade 230. Here, mounting 222 is joined to frame 108 by way of housing 128 of charging subsystem 120. As noted above, charging subsystem housing 128 is precisely located relative to electrostatic imaging member 112 and as is illustrated here, this precise relationship takes the form of positioning housing 128 at a charging subsystem distance 125 that is within a range of charging subsystem distances 123 relative to electrostatic imaging member 112. Accordingly, as is shown in FIG. 8A, charging subsystem housing 128 can be positioned at a far distance 127 from electrostatic imaging member 112 and a near distance 129 to electrostatic imaging member 112. In one non-limiting example, the far distance 127, for example, can be as far as about 125 um greater than a nominal charging subsystem distance shown here as charging subsystem distance 125 while the near distance 129 can be about 125 um less than a nominal charging subsystem distance shown here as distance 125 to provide a range of charging subsystem distances 123 that is about 250 um. Other ranges are possible and the amount of variation need not be symmetric about such a nominal charging subsystem distance 125.

As is shown in greater detail in FIGS. 8A and 8B, by fixing mounting 222 to housing 128 of charging subsystem 120 it becomes possible to position mounting 222 at a mounting distance 225 that is based upon the charging subsystem distance 125 and that is controlled to be within a range of mounting distances 233 that is generally equal to the range of charging subsystem distances 123. This arrangement enables a mounting 222 to be positioned within a range of mounting distances 233 that is between about 125 um greater than or 125 um less than a determined distance from electrostatic imaging member 112. In this example, the mounting distance 225 is illustrated as being measured along a lower edge of mounting 222. However, this is not critical and other points on mounting 222 can be used for such a measurement.

Mounting 222 positions a first end 232 of cleaning blade 230 so that an undeflected free length 236 of cleaning blade 230 extends along a holding angle 224 toward electrostatic imaging member 112. An extension distance 240 is measured along the holding angle 224 and represents the distance between point where mounting 222 ceases to hold cleaning blade 230 and is less than a free length 236 of cleaning blade 230. As is shown here, in phantom the free length 236 of a non-deflected cleaning blade 230 likewise extends from a position where mounting 222 ceases to hold cleaning blade 230 to second end 234 of undeflected cleaning blade 230. The extent to which free length 236 exceeds extension distance 240 is known in the art as an engagement distance 241.

In this embodiment, mounting 222 is fixed to housing 128 of charging subsystem 120. Accordingly, it becomes possible to position mounting 222 at a mounting distance 225; free length 236 exceeds extension distance 240 by what is known in the art as an engagement distance 241. Cleaning end 234 of cleaning blade 230 is resiliently deflected by an extent of deflection 237 that allows free length 236 to fit within extension distance 240. The extent of deflection 237 is determined based upon holding angle 224, free length 236 and engagement distance 241. Deflection 237 causes cleaning end 234 of cleaning blade 230 to bend to contact electrostatic imaging member 112 at a working angle 242.

As will be discussed in greater detail below with respect to FIGS. 9 and 10, extension distance 240 determines in part engagement distance 241 and can have a significant impact on working angle 242 of a cleaning blade 230. However, the extension distance 240 can vary within a range 238 of extension distances that is determined according to the range of mounting distances 233, which, in turn, is based on the relationship of the location of mounting 222 and the electrophotographic imaging member 112.

Figure 9:
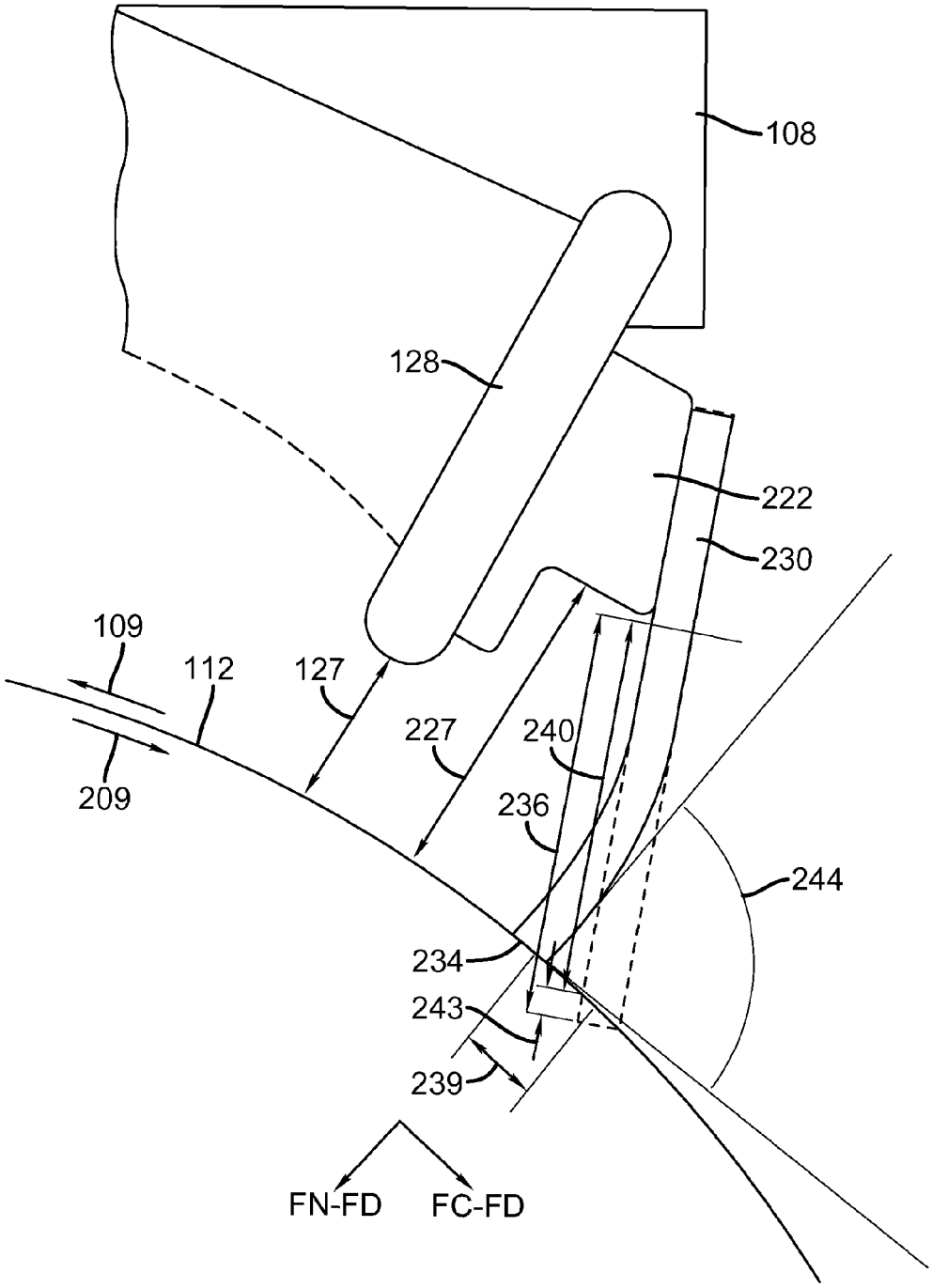

FIG. 9 shows the embodiment of FIGS. 8A and 8B with charging subsystem housing 128 positioned at far distance 127. As is shown in FIG. 9, when charging subsystem housing 128 is at far distance 127, mounting 222 can also be at a far distance 227 from electrostatic imaging member 112. This change from the positions illustrated in FIGS. 8A and 8B, lengthens extension distance 240 while free length 236 remains the same and creates an engagement distance 243 that is less than the engagement distance 241 shown in FIG. 8A. These changes create a far distance deflection 239 of cleaning blade 230 at cleaning end 234 that is less than the deflection 237 charging subsystem housing 128 is at charging subsystem distance 125. This in part determines a far distance working angle 244 between cleaning end 234 and electrostatic imaging member 112 that yields a far distance cleaning force FC-FD and far distance normal force FN-FD. As is further shown in FIG. 9, the far distance cleaning force FC-FD is proportionately greater than the far distance normal force FN-FD.

Figure 10:
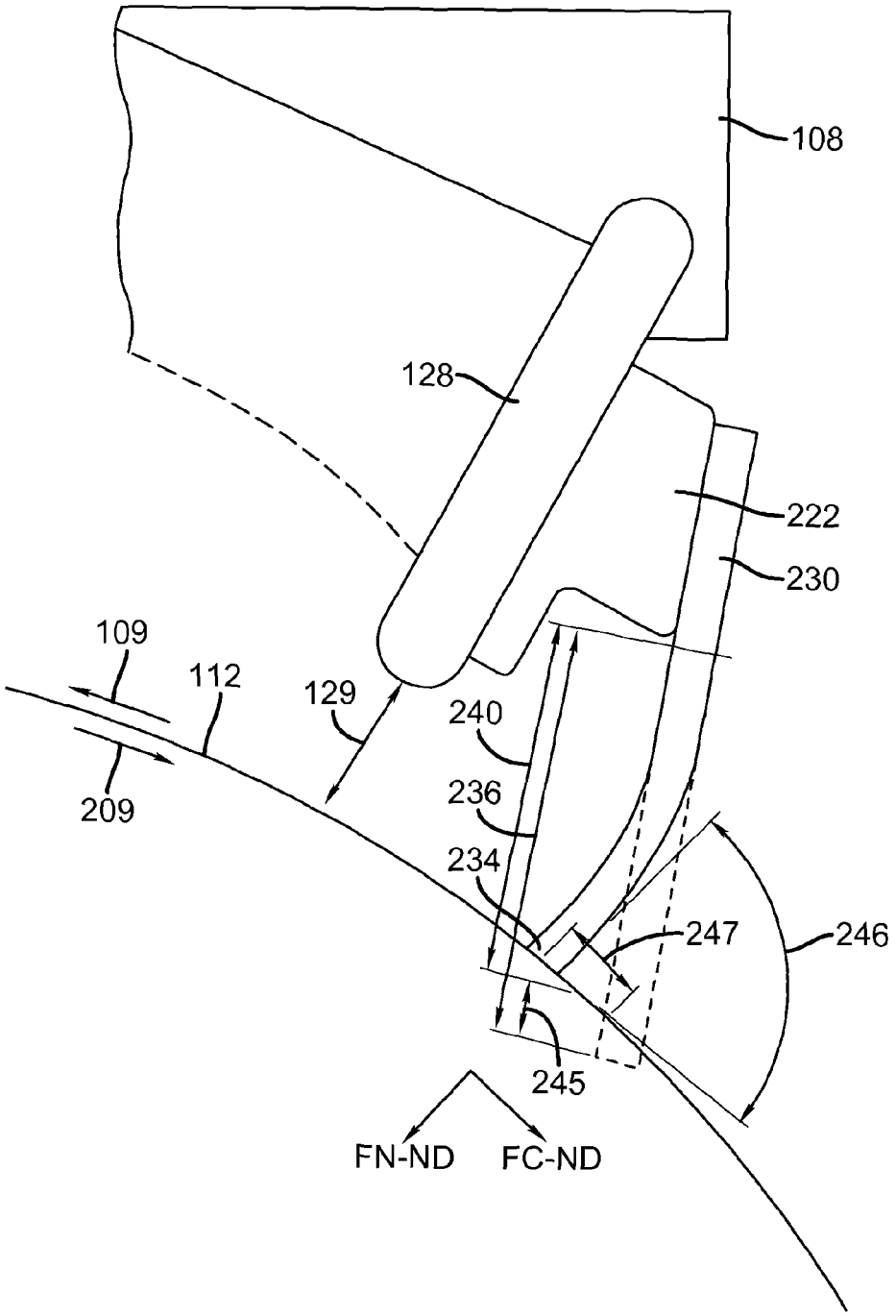

In contrast, as is shown in FIG. 10, when charging subsystem housing 128 is at near distance 129, extension distance 240 is reduced while free length 236 remains the same. This creates an increased engagement distance 245, which creates a near distance deflection 247 of cleaning blade 230. Near distance deflection 247 is greater than deflection 237 shown in FIGS. 8A and 8B. The deflection of cleaning blade 230 forms a near distance working angle 246 that is less than working angle 242 shown in the arrangement of FIGS. 8A and 8B. This near distance working angle 246 yields a near distance cleaning force FC-ND that is more proportional to a near distance normal force FN-ND than the far distance cleaning force FC-FD is to the far distance normal force FN-FD.

It will be appreciated from this that by positioning mounting 222 on a component of the printing module 48 that, for reasons that are integral to the function of that component, requires the component to be precisely positioned with respect to electrostatic imaging member 112 it becomes possible to provide a cleaning blade 230 that has a more controlled range of working angles. Because cleaning blade 230 can be positioned within such a controlled range of positions, there is a reduced need to cause cleaning blade 230 to have a free length 236 that is sufficient to maintain engagement with electrostatic imaging member 112 across a large range of mounting distances (not shown). This in turn allows cleaning blade to be useful within the smaller range and with less deflection which can enable a smaller range of higher working angles to be provided.

Accordingly, by positioning cleaning blade 230 using a reference structure that has a precise positional relationship with the electrostatic imaging member 112, it is possible to achieve a range of working angles 242 when cleaning blade 230 is used for wiping that are greater than the working angles of an alternative range of working angles if the cleaning blade 230 were positioned within an alternative range (not shown) of extension distances that is greater than the range 238 of extension distances 240. This, in turn, allows the cleaning force FC provided by cleaning blade 230 when used for wiping that is proportionately greater than the normal force FN thus providing greater cleaning efficiency while also lowering friction and the attendant difficulties associated with higher levels of normal force FN. Such outcomes are impractical to achieve and maintain in systems where there is less control of this positional relationship.

In this embodiment, the reference structure is the charging subsystem housing 128. In another non-limiting example such a reference structure can be a development station 140 which is also generally precisely located relative to electrostatic imaging member 112. In other embodiments, mounting 222 can be directly supported by frame 108. In sum, a cleaning system 200 can be provided that provide advantageous ratios of cleaning force FC to normal force FN on the order of those found in scraping systems but that do so without the risks of catastrophic failure associated with such scraping systems and that do so without occasioning the high normal forces associated with prior art wiping systems. Further, it will be appreciated that the transitional cleaning system 220 is not as vulnerable to the chatter effect as are scraping systems. This is because the transitional cleaning system 220 does not resist the movement of electrostatic imaging member 112 and therefore can achieve a more stable steady state dynamic relationship with the electrostatic imaging member 112 and because the normal forces of a cleaning blade 230, even at higher working angles 242 are still greater than those of a scraper and therefore tend to follow the surface of electrostatic imaging member 112 more closely.

Cleaning blade 230 can be formed from any of a variety of materials. These can include materials such as polyurethane, polycarbonate, acetal, phosphorous, bronze, and stainless steel. In one embodiment, cleaning blade 230 can be a polyester polyurethane having a thickness between about 0.8 mm and 1.2 mm and a Shore A between about 80 and 90. In such an embodiment an engagement distance of between about 1 mm to 1.5 mm can be used. Optionally, cleaning blade 230 can be coated in whole or in part to add strength, stiffness or to otherwise adjust properties as required. For example a cleaning blade 230 can be coated with a submicron Polymethyl Methacrylate powder dispersed on the second end 234. When such a powder is applied to second end 234 of a cleaning blade 230 having a Shore A between 80-90, or in some embodiments and in other embodiments a Shore A of greater than 60 there can be a reduction in tuck under risk. However, it will be appreciated that with greater control of the ratio of normal forces and cleaning forces by virtue of better control of the geometric positioning of the scraper, it becomes possible to form a scraper made using a wider range of materials.

In the embodiment that is illustrated in FIGS. 5-10, a mounting 222 has been shown that provides a holding angle 224 that is greater than 90 degrees and that therefore mounting 222 arranges a cleaning blade 230 in part along a first direction 209 that is against a direction of movement 109 of electrostatic imaging member 112 to position cleaning end 234 to engage electrostatic imaging member 112. Such an arrangement typifies a cleaning blade 230 for scraping and not a wiper. FIGS. 11 and 12 will now illustrate one embodiment of a process by which cleaning blade 230 is transitioned into the positions that are illustrated in FIGS. 5-10.

As is shown in FIG. 11, a frame 108 positions mounting 222 at a mounting distance 227 that is within a range of mounting distances 233 as discussed in greater detail above with respect to FIG. 8A. Mounting 222 holds cleaning blade 230 at a holding angle 224 that causes cleaning blade 230 to extend in part along a first direction 209 to position cleaning end 234 of the cleaning blade 230 to engage electrostatic imaging member 112 for movement therewith. Electrostatic imaging member 112 is moved along the direction of movement 109 that is opposite the first direction 209 by a motor or other type of actuator. When arranged in this manner, mechanical engagement between electrostatic imaging member 112 and cleaning end 234 urges cleaning blade 230 to deflect from first direction 209 so as to allow cleaning end 234 to move with electrostatic imaging member 112. To accommodate such movement, cleaning blade 230 must be capable of being moved through a nip area 252 between electronic imaging member 112 and mounting 222.

As is shown in FIG. 12, cleaning blade 230 deflects as necessary to enable cleaning blade 230 to fit through nip area 252 between mounting 222 and electrostatic imaging member 112. Such deflection can be necessary where the free length 236 is greater than the mounting distance 227 or range of mounting distances 233. It will be understood that the depiction in FIG. 12 of the deflection that occurs to fit cleaning blade 230 through nip area 252 is only one possible type of deflection that may occur in certain embodiments. For example, and without limitation, in other embodiments, the deflection that occurs to enable cleaning blade 230 to pass through nip area 252 can involve deflection in part along first direction 209 or the direction of movement 109 of electrostatic imaging member 112, or deflections in both directions. It will also be understood that the free length 236 is greater than the first range of mounting distances 223 and the cleaning blade is elastically deformable so as to allow the free length 236 of the cleaning blade to deflect from the first direction 209 to the direction of movement 109 of the electrostatic imaging member 112 so that the cleaning blade 230 resiliently biases the cleaning end 234 in the first direction 209.

In this embodiment, free length 236, holding angle 224 and the range of mounting distances 233 cause cleaning end 234 to wipe electrostatic imaging member 112 at a working angle between 85 and 89 degrees. Such working angles are particularly difficult to achieve and to maintain using wiper cleaning systems that do not have such precise control over positioning and that hold a wiper at angles that are below 90 degrees.

It will be appreciated that the use of the transitional cleaning system 220 provides a cleaning blade that acts as a high working angle wiper provides scraper like ratios of cleaning force and normal forces and does not suffer from the key problems that are associated with scrapers. In particular the transitional cleaning system 220 uses a wiping action which reduces the cleaning forces experienced during cleaning of the electrostatic imaging member 112 as opposed to those experienced by a scraper. This wiping action tends to mitigate or eliminate issues such as chatter and the risks created by high forces that can arise during scraping operations. These advantages can be valuable in circumstances where a mounting 222 is positioned relative to an electrostatic imaging member 112 by locating mounting 222 on a component of an electrophotographic printer that is precisely located relative to the electrostatic imaging member such as a charging subsystem housing 128 because there is a desire not to upset such precise positioning through the transfer of scraping forces through cleaning blade 230 and mounting 222 to charging subsystem housing 128.

Similarly, it will be understood that transitional cleaning system 220 also that avoids many of problems of prior art wiping systems. For example the high working angles of the transitional cleaning system 220 provide a greater proportion of cleaning force than normal force than do conventional wiping systems.

Further, transitional cleaning system 220 avoids other problems that are associated with wiping systems. In particular, it will be understood that during installation and maintenance the mounting and electrostatic imaging member are typically physically separated to allow the installation or maintenance personnel to have access to the mounting without risk of damaging the electrostatic imaging member. However, when such a conventional wiper is brought back into contact with the electrostatic imaging member there is a risk that the such a conventional wiper will engage the electrostatic imaging member in a way that allows the conventional wiper to act as a column such that conventional wiper will resist deflection until substantial forces are applied to the wiper. This can cause significant force to be applied to the electrostatic imaging member which can damage the electrostatic imaging member.

It will be appreciated that these risks are further complicated during wiper maintenance procedures because a conventional wiper cleans an electrostatic imaging member at a first position along a direction of movement of an electrostatic imaging member that is further along a direction of movement 109 of the electrostatic imaging member 112 than a second position where an undeflected wiper will contact the electrostatic imaging member 112 often. There is an accumulated amount of second residual material that has been loosened from but not yet removed from electrostatic imaging member at a time when wiper is separated from primary imaging member. This accumulation can extend from the first position past the second position. When this occurs, this mass of residual material can interfere with such a wiper during reinstallation causing the wiper to deflect to a scraping orientation or to drive directly into electrostatic imaging member which can damage electrostatic imaging member or the wiper.

The use of transitional cleaning system 220 can help to protect against such problems. In particular, it will be observed, with reference again to FIG. 11, that when cleaning blade 230 extends along first direction 209 to bring cleaning end 234 into engagement with electrostatic imaging member 112 the point of engagement is shifted away from the area last wiped and extends in first direction 209. This ensures that engagement occurs outside an area that is unlikely to have any significant accumulation of residual material. It will also be understood that such engagement occurs at an angle that lessens the likelihood that cleaning blade 230 will act like a column during such contact.

In transitional cleaning system 220, engagement between cleaning end 234 and an electrostatic imaging member 112 that causes movement of cleaning end 234 when electrostatic imaging member 112 is moved by an actuator such as a motor that is beginning to accelerate from a stop to a production rate of rotation. The friction that can arise during such a start up operation can be sufficient to cause cleaning end 234 to be moved along electrostatic imaging member 112 so that cleaning blade 230 deflects in a manner that causes a portion of cleaning blade 230 that positions cleaning end 234 to extend along the second direction 209 to a position that provides provide a high working angle wiper of the type that is illustrated in FIGS. 5-10. However, both dynamic and static friction can also provide sufficient engagement under other circumstances. In other circumstances, the residual material itself can help cleaning end 234 and electrostatic imaging member 112 to engage in a manner that enables a transition.

As is further noted above, some energy is supplied by the electrostatic imaging member 112 to facilitate the transition of cleaning blade 230 from the configuration shown in FIG. 11 to the high working angle wiper configuration shown in FIGS. 5-10. This energy subtracts from the energy used to drive movement of electrostatic imaging member 112 which can have consequences with respect to the movement of the electrostatic imaging member 112. However, the precise placement of the mounting 222 relative to the electrostatic imaging member 112 reduces the overall amount of energy required to drive such a transition by reducing the extent of free length 236 of cleaning blade 230 that is required to allow a cleaning blade 230 to sustain contact with an electrostatic imaging member 112 over a range of potential variations in mounting distances. Further, as is shown in FIG. 12 cleaning blade 230 can resiliently deflect during this transition so as to provide an additional amount of energy required to cause clean blade 230 to make this transition. Therefore the amount of energy that is required to deflect free length 236 is lower both because less material must be deflected than would be required in the event of less precise placement and because less deflection is required to cause cleaning blade 230 to transition from extending in first direction 209 to position the cleaning end 234 to engage the electrostatic imaging member 112 to extending in the direction of movement 109 to position the cleaning end 234 to wipe the electrostatic imaging member 112. Accordingly, an amount of energy required to deflect cleaning blade 230 to the second direction 209 is less when the mounting 222 is positioned in the first range of mounting distances 223 than when the mounting is positioned within a second range of mounting distances (not shown) that is larger than the first range of mounting distances.

FIG. 13 shows yet another embodiment of transitional cleaning system 220. As is shown in FIG. 13, in this embodiment cleaning end 234 has an engagement side 254 that contacts electrostatic imaging member 112 when cleaning blade 230 positions cleaning end to engage electrostatic imaging member 112 and a cleaning side 256. Cleaning side 256 contacts electrostatic imaging member 112 when the cleaning blade 230 is in the wiping position shown for example in FIGS. 5-10.

In this embodiment, the engagement side 254 and the cleaning side 256 are different. For example, engagement side 254 can be shaped, processed, treated, manufactured, fabricated or otherwise provided in any way that helps cleaning end 234 to engage electrostatic imaging member 112 so that movement of electrostatic imaging member 112 causes cleaning blade 230 to transition from extending to position cleaning end 234 for engagement to extending to position cleaning end 234 to wipe the electrostatic imaging member.

Cleaning side 256 can be shaped, processed, coated, manufactured, and fabricated in ways that provide desired wiping characteristics when cleaning blade 230 is in the wiping position. For example, cleaning side 256 can have features such as shapes, mechanical properties or chemical properties that are determined to enhance at the wiping of residual material from electrostatic imaging member 112. In another example, cleaning side 256 can have features that are provided to help extend the useful life of the electrostatic imaging member 112 such as by reducing friction as can be done by providing friction reducing materials or coatings on cleaning side 256. In still another example, cleaning side 256 can have features that are provided to manage triboelectric effects caused by wiping the electrostatic imaging member 112 as can be done through the selection of particular materials to engage the electrostatic imaging member to control or limit triboelectric charging that may occur during wiping.

The invention has been described in detail with particular reference to certain preferred embodiments thereof, but it will be understood that variations and modifications can be effected within the scope of the invention

What is claimed is:

1. A transitional cleaning system for an electrostatic imaging member comprising:

an actuator that moves the electrostatic imaging member in a second direction opposite a first direction; and a frame positioning a mounting within a range of mounting distances from the electrostatic imaging member with the mounting holding a cleaning blade at a holding angle that causes a free length of the cleaning blade to extend along the first direction to position a cleaning end of the cleaning blade to engage the electrostatic imaging member for movement therewith;

wherein the electrostatic imaging member urges the engaged cleaning end in the second direction to deflect the cleaning blade so that the cleaning blade extends along the second direction to position the cleaning end of the cleaning blade to wipe the electrostatic imaging member; and wherein the free length and the holding angle and the mounting distance cause the cleaning edge to wipe the electrostatic imaging member at a working angle between about 85 and 89 degrees.

2. The transitional cleaning system of claim 1, wherein the free length is greater than the range of mounting distances and the cleaning blade is elastically deformable so as to allow the free length of the cleaning blade to deflect from the first direction to the second direction and so that the cleaning blade resiliently biases the cleaning end in the first direction.

3. The transitional cleaning system of claim 1, wherein the engagement comprises a frictional force between the electrostatic imaging member and the cleaning end.

4. The transitional cleaning system of claim 1, wherein the engagement comprises at least in part engagement between the cleaning end and residual material on the electrostatic imaging member.

5. The transitional cleaning system of claim 1, wherein the frame positions the mounting by fixing the mounting to a component of a printing module in which the electrostatic imaging member is used and that is maintained within a range of distances from the electrostatic imaging member by the frame.

6. The transitional cleaning system of claim 1, wherein the cleaning end of the cleaning blade has an engagement side that contacts electrostatic imaging member when the cleaning blade extends along the first direction to position the cleaning edge against the electrostatic imaging member and a cleaning side that contacts electrostatic imaging member wherein when the cleaning blade extends in the second direction to position the cleaning end to wipe the electrostatic imaging member the cleaning side contacts the electrostatic imaging member and wherein the engagement side and the cleaning side are different.

7. The transitional cleaning system of claim 6, wherein the engagement side provides features that are determined to enhance engagement between the cleaning end and the electrostatic imaging member to help cause the cleaning end to move with the electrostatic imaging member so that the cleaning blade can transition from extending along the first direction to position the cleaning end to engage the electrostatic imaging member to extending along the second direction to position the cleaning end to wipe the electrostatic imaging member.

8. The transitional cleaning system of claim 1, wherein the cleaning side provides features that are determined to provide at least one of enhanced wiping of the electrostatic imaging member, extended useful life of the electrostatic imaging member and management of triboelectric effects caused by wiping the electrostatic imaging member.

9. A transitional cleaning system for an electrostatic imaging member comprising:

an actuator that moves the electrostatic imaging member in a second direction opposite a first direction; and a frame positioning a mounting within a range of mounting distances from the electrostatic imaging member with the mounting holding a cleaning blade at a holding angle that causes a free length of the cleaning blade to extend along the first direction to position a cleaning end of the cleaning blade to engage the electrostatic imaging member for movement therewith;

wherein the electrostatic imaging member urges the engaged cleaning end in the second direction to deflect the cleaning blade so that the cleaning blade extends along the second direction to position the cleaning end of the cleaning blade to wipe the electrostatic imaging member;

wherein the free length and the holding angle and the mounting distance cause the cleaning edge to wipe the electrostatic imaging member at a working angle between about 85 and 89 degrees; and wherein the free length is greater than the first of mounting distances and the cleaning blade is resiliently flexible to allow the cleaning blade to deflect from the first direction to the second direction.

10. A printer comprising a printing module comprising an electrostatic imaging member;

a charging subsystem for generating a generally uniform pattern of differences of potential on an electrostatic imaging member;

a writing system for forming a pattern of differences of potential at pixel locations on the electrostatic imaging member according to a pattern of toner to be formed on the electrostatic imaging member with the differences of potential capable of attracting residual materials to the electrostatic imaging member;

a development system providing charged toner and a development potential that causes the charged toner to develop on the electrostatic imaging member according to the differences of potential at the pixel locations;

a transfer system providing a surface onto which a substantial portion of the toner on the electrostatic imaging member is transferred for subsequent transfer onto a receiver;

a cleaner applying cleaning forces to remove residual material including toner from the electrostatic imaging member;

a cleaning system with a mounting holding a cleaning blade so that a free length of the cleaning blade extends from the mounting toward the electrostatic imaging member;

a frame positioning a mounting within a range of mounting distances from an electrostatic imaging member with the mounting holding a cleaning blade at a holding angle that causes a free length of the cleaning blade to extend along a first direction to position a cleaning end of the cleaning blade to engage the electrostatic imaging member for movement therewith;

an actuator that moves the electrostatic imaging member in a second direction opposite the first direction; and wherein the electrostatic imaging member urges the engaged cleaning end in the second direction to deflect the cleaning blade so that the cleaning blade extends along the second direction to position the cleaning end of the cleaning blade to wipe the electrostatic imaging member; and wherein the free length and the holding angle and the mounting distance are such that the cleaning edge wipes the electrostatic imaging member at a working angle between about 85 and 89 degrees.

11. The printer of claim 10, wherein the free length is greater than the range of mounting distances and the cleaning blade is resiliently flexible to allow the cleaning blade to deflect from the first direction to the second direction.

12. The printer of claim 10, wherein the free length is greater than the range of mounting distances and the cleaning blade is elastically deformable so as to allow the free length of the cleaning blade to deflect from extending along the first direction to extending at least in part along the second direction and so that the cleaning blade resiliently biases the cleaning end in the first direction.

13. The printer of claim 10, wherein the mechanical engagement comprises a frictional force between the electrostatic imaging member and the cleaning end.

14. The printer of claim 10, wherein the engagement comprises at least in part engagement between the cleaning end and residual material on the electrostatic imaging member.

15. The transitional cleaning system of claim 10, wherein the cleaning end of the cleaning blade has an engagement side that contacts electrostatic imaging member when the cleaning blade extends along the first direction to position the cleaning edge against the electrostatic imaging member and a cleaning side that contacts electrostatic imaging member when the cleaning blade extends in the second direction to position the cleaning end to wipe the electrostatic imaging member the cleaning side contacts the electrostatic imaging member and wherein the engagement side and the cleaning side are different.

16. The transitional cleaning system of claim 15, wherein the cleaning side provides features that are determined to provide at least one of enhanced wiping of the electrostatic imaging member, extended useful life of the electrostatic imaging member and management of triboelectric effects caused by wiping the electrostatic imaging member.

17. The transitional cleaning system of claim 10, wherein the engagement side provides features that are determined to enhance engagement between the cleaning end and the electrostatic imaging member to help cause the cleaning end to move with the electrostatic imaging member so that the cleaning blade can transition from extending along the first direction to position the cleaning end to engage the electrostatic imaging member to extending along the second direction to position the cleaning end to wipe the electrostatic imaging member.

18. A transitional cleaning system for an electrostatic imaging member comprising:

an actuator that moves the electrostatic imaging member in a second direction opposite a first direction; and a frame positioning a mounting within a range of mounting distances from the electrostatic imaging member with the mounting holding a cleaning blade at a holding angle that causes a free length of the cleaning blade to extend along the first direction to position a cleaning end of the cleaning blade to engage the electrostatic imaging member for movement therewith;

wherein the electrostatic imaging member urges the engaged cleaning end in the second direction to deflect the cleaning blade so that the cleaning blade extends along the second direction to position the cleaning end of the cleaning blade to wipe the electrostatic imaging member; and wherein the free length is greater than the range of mounting distances and the cleaning blade is elastically deformable so as to allow the free length of the cleaning blade to deflect from the first direction to the second direction and so that the cleaning blade resiliently biases the cleaning end in the first direction.

* * * * *